US005588484A

United States Patent [19]

Baker et al.

[11] Patent Number: 5,588,484

[45] Date of Patent: Dec. 31, 1996

[54] REFRIGERATION FAN SYSTEM

[75] Inventors: Gerald N. Baker, Florissant; Gregory R. Maes, Winchester, both of Mo.

[73] Assignee: Emerson Electric Co., St. Louis, Mo.

[21] Appl. No.: 292,848

[22] Filed: Aug. 19, 1994

[51] Int. Cl.[6] ..... B60H 1/32

[52] U.S. Cl. ..... 165/122; 165/124

[58] Field of Search ..... 165/122, 124

[56] References Cited

U.S. PATENT DOCUMENTS 4,958,504 9/1990 Ichikawa et al. ..... 165/122 X

*Primary Examiner*—John C. Fox

*Attorney, Agent, or Firm*—Polster, Lieder, Woodruff & Lucchesi

[57] ABSTRACT

In a refrigeration system in which coils are mounted in a coil passage, a fan system is provided by which air is caused to pass over the coils. The fan system includes a housing communicating with a coil passage. The housing has an inlet and an outlet each with a mouth, the mouths of the inlet and outlet being oriented substantially 180° from one another. A cylindrical, elongated transverse flow fan is mounted in the housing transversely thereof and an electric motor is connected to rotate the fan. An inlet baffle extends around a part of the fan. An outlet baffle has a scoop part with a free edge extending along the length of the fan, spaced radially from the fan a short distance, and off set toward the outlet mouth. The outlet baffle, including the scoop part, defines one service of a passage to the outlet mouth. The air that passes through the housing flows through the inlet and the outlet mouths in planes substantially parallel with one another.

4 Claims, 2 Drawing Sheets

REFRIGERATION FAN SYSTEM

BACKGROUND OF THE INVENTION

Refrigeration systems, whether they be household or commercial refrigerators or freezers, or air conditioners or dehumidifiers, and whether they be absorption type or compression type systems, use two sets of coils, condenser coils and evaporator coils. The condenser coils require cooling. In modern refrigeration systems, cold air from the evaporator coils is circulated by means of a fan. In either case, space considerations are important. The coils are generally located in a coil passage defined by spaced front and back walls, generally parallel with one another, defining a passage that is wide relative to its depth, e.g. 16" wide and less than 3" deep. Axial flow fans have been used, but they occupy more space than is desirable, do not provide for a straight flow-through pattern, and do not necessarily provide uniform distribution over the coils.

One of the objects of this invention is to provide a fan system that occupies a minimum amount of space, while providing a relatively even flow of air across the coils, and improved efficiency as compared with systems known heretofore.

Other objects will become apparent to those skilled in the art in the light of the following description and accompanying drawing.

SUMMARY OF THE INVENTION

In accordance with this invention, generally stated, in a refrigeration system in which coils are mounted in a coil passage defined by front and back walls, the walls being spaced from one another a short distance relative to their width, a fan system is provided by which air is caused to pass over the coils. The fan system includes a housing communicating with the coil passage, the housing having an inlet and a outlet each with a mouth. The mouths of the inlet and outlet are oriented substantially 180° from one another. A cylindrical, elongated transverse flow fan is mounted in the housing transversely of it, driven by an electric motor. Baffles are provided for directing air through the inlet to the fan and from the fan through the outlet, the flow of air through the mouths lying in substantially parallel planes. Particularly when the fan system is associated with evaporator coils, the inlet mouth of the fan housing communicates directly with the coil passage. In either case, the baffle on the outlet side has an arcuate scoop part with a free edge extending along the fan, parallel to the axis of rotation of the fan, spaced from the exterior of the fan a short distance and off-set in a direction toward the outlet mouth. The outlet baffle defines one surface of a passage communicating with the outlet mouth.

The fan system delivers at least forty cubic feet per minute of air at 0.11" of static pressure, at 3,620 rpm.

Preferably the motor driving the fan is a brushless permanent magnet motor, which can be of the type described in co-pending application Ser. No. 08/237,782.

IN THE DRAWINGS

DESCRIPTION OF THE PREFERRED EMBODIMENT

Figure 2:
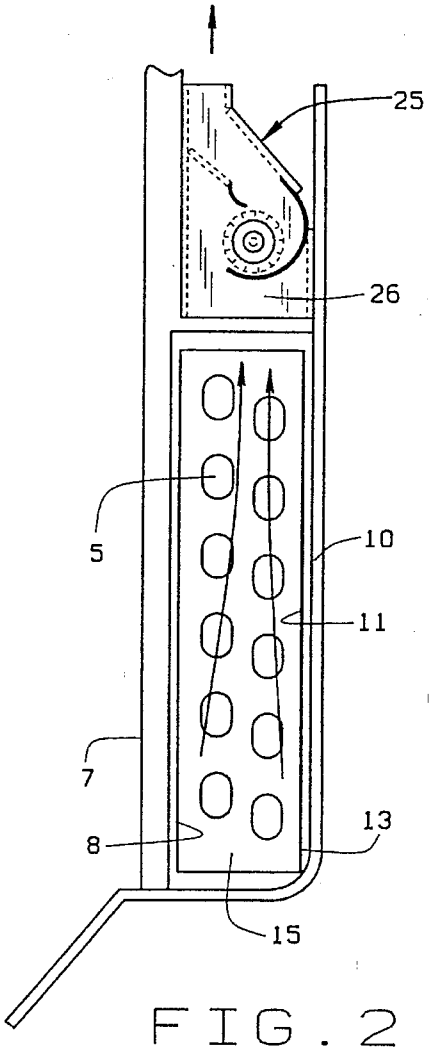
FIG. 2 is a sectional view taken along the line 2—2 of FIG. 1.
Figure 1:
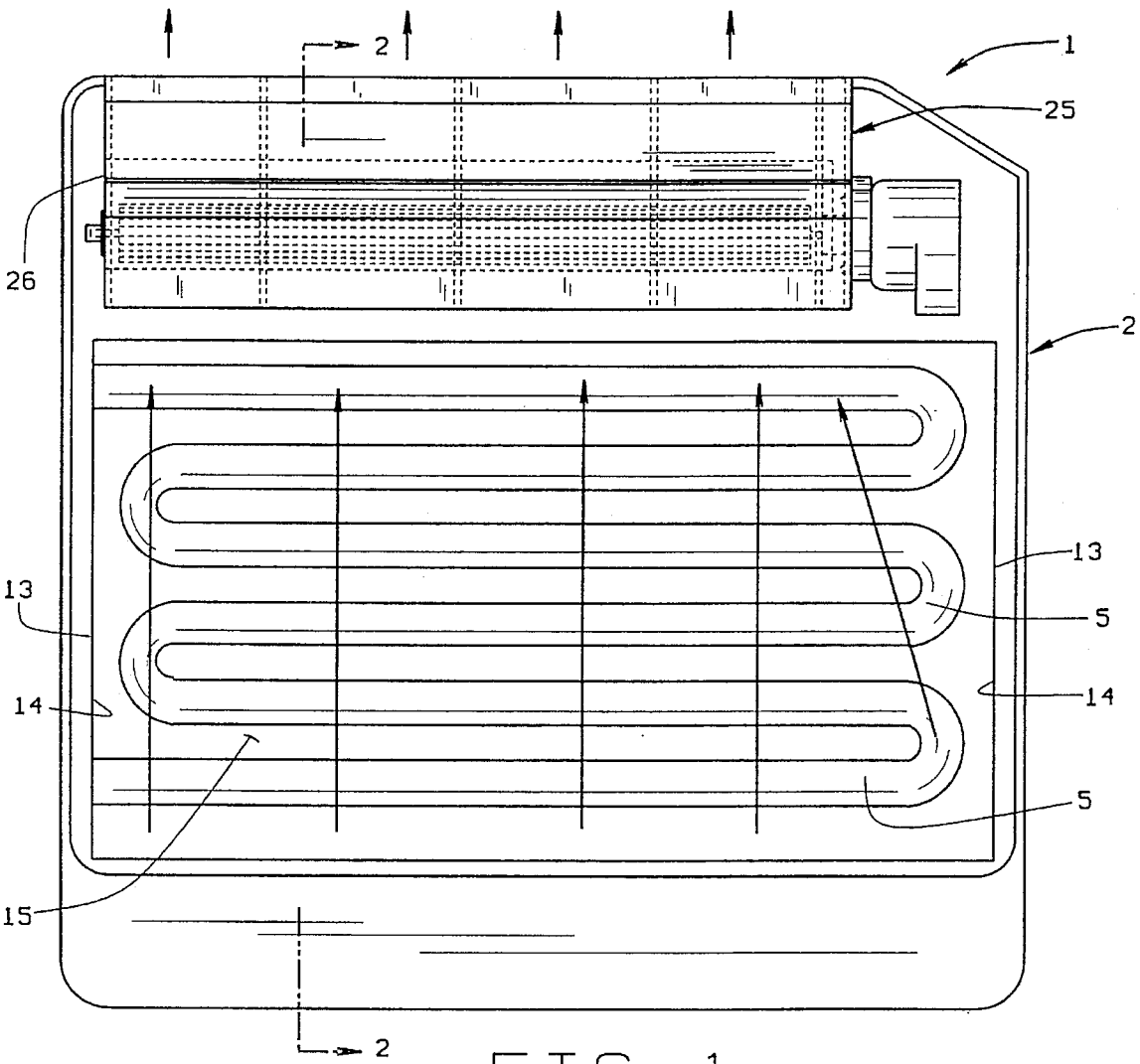
FIG. 1 is a view in front elevation of an evaporator in a refrigerator.
Figure 3:
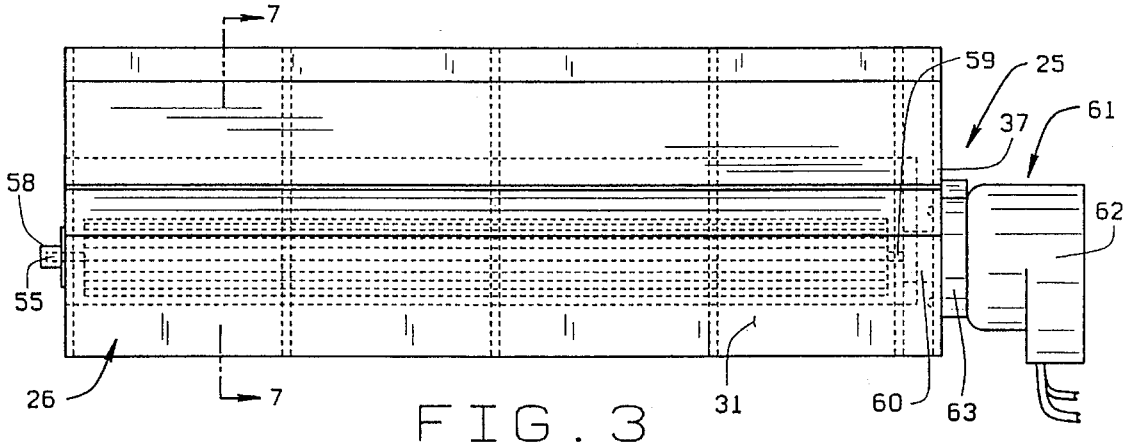
FIG. 3 is a view in front elevation of a fan assembly of this invention.
Figure 5:
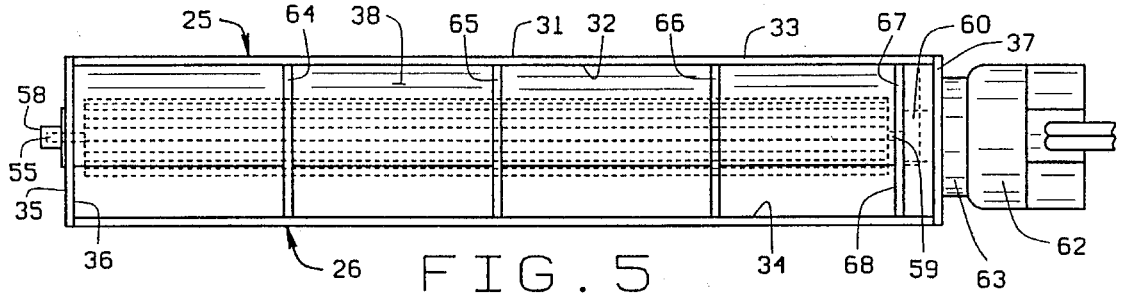
FIG. 5 is a bottom plan view.
Figure 6:
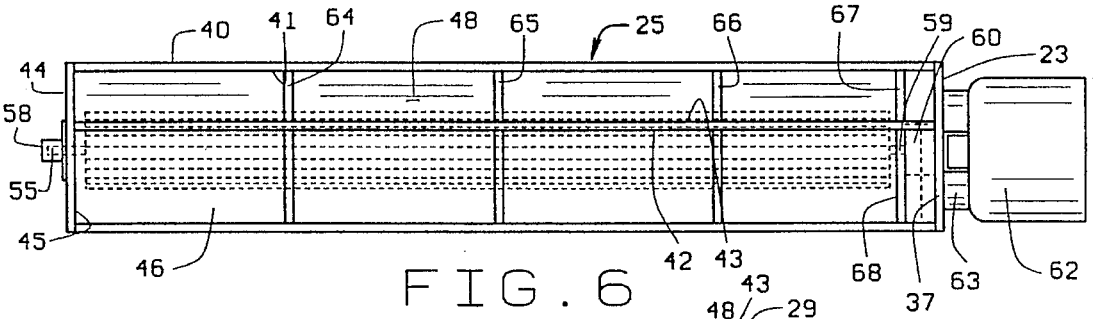
FIG. 6 is a top plan view.
Figure 4:
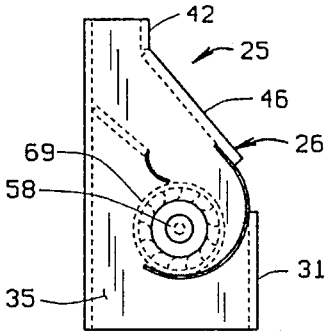
FIG. 4 is an end view, viewed from left to right of FIG. 3.
Figure 7:
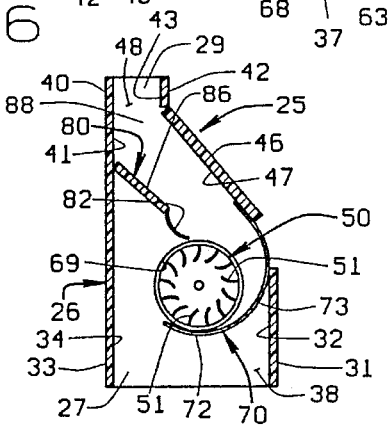
FIG. 7 is a sectional view taken along the lines 7—7 of FIG. 3.
Figure 8:
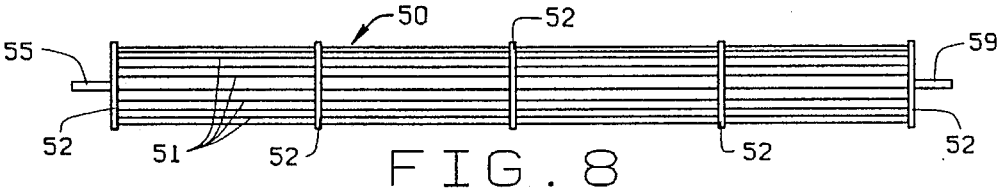
FIG. 8 is a view in side elevation of a fan rotor of FIGS. 1 through 7.

Referring now to the drawing for one illustrative embodiment of this invention, reference numeral 1 indicates a refrigerant system with an evaporator 2. Evaporator coils 5 are arranged in a coil passage 15 defined by an inner surface 8 of a front wall 7 and an inner surface 11 of a back wall 10, and inner surfaces 14 of side walls 13.

A fan assembly 25 is, in this illustrative embodiment, mounted on the upper end of the coil passage 15. The assembly includes a housing 26 which has an inlet 27 and an outlet 29. The inlet 27 is defined in part by an inner surface 32 of an inlet back wall 31, which can be an extension of the back wall 10 of the coil passage 15, and an inner surface 34 of an inlet front wall 33, which can be an extension of the front wall 7 of the coil passage 15. The inlet is further defined by an inner surface 36 of an outboard inlet side wall 35. A fourth side of the inlet 27 is provided by an inner surface 68 of a divider wall 67, as will be explained hereinafter. An inboard or motor end side wall 23, which can be an extension of a side wall 13 of the evaporator, is spaced from and parallel to the divider wall 67.

The inner surfaces 32, 34, 36 and 68 define an inlet mouth 38.

The outlet 29 is defined by an inner surface 41 of an outlet front wall 40, which is shown as merely a continuation of the front walls 33 and 7, inner surface 43 of an outlet back wall 42, and inner surface 45 of an outboard outlet side wall 44, which can be an extension, albeit relatively narrow, of the side wall 35, and an inner surface 68 of the divider wall 67, similarly reduced in width.

An intermediate front wall 46, with an inner surface 47, is shown as extending from a lower edge of the outlet back wall 42, flaring outwardly toward the inlet back wall but being connected along a lower margin to an outside surface of a baffle, as will be described in detail hereinafter.

A fan rotor 50 is mounted for rotation on an outboard shaft 55 and a drive shaft 59, projecting axially outwardly from end plates 52. The shaft 55 is journaled for rotation in an outer bearing 58 mounted in and carried by the side wall 35. The drive shaft 59 is journaled for rotation in a motor bearing 60, part of a motor assembly 61 that is mounted on and carried by a side wall 37. The motor assembly 61 includes a motor, shown here as a brushless permanent magnet motor, of the type described in application Ser. No. 08/237,782, and a motor mounting bracket 63.

In this embodiment, the interior of the housing is divided by divider walls 64, 65 and 66, into four segments. Each of the divider walls extends from the open mouth 38 of the inlet to the open mouth 48 of the outlet. The divider walls 64, 65 and 66 have in them openings 69 through which the fan rotor 50 extends with sufficient space to permit the rotor to rotate freely. A fourth divider wall 67, is positioned a relatively short distance inboard of the end wall 23, and has an opening adapted to receive a bearing housing part of the motor bracket. The motor bracket 63 is mounted on the end wall 37, and the bearing assembly 60 projects through an opening in the wall 37, into the space between the wall 37 and the divider wall 67.

An intake baffle 70, extending throughout the length of the fan rotor has a part 72 extending beneath and spaced a short distance from the rotor with respect to the intake mouth 38, and a volute section 73, that extends radially outwardly progressively from the rotor 50, and joins the inside surface 47 of the intermediate front wall 46, along the upper edge of the intake baffle.

An outlet baffle 80 has, extending along the length of the rotor 50, a scoop section 82, a free edge of which extends near, but spaced from the rotor, off-set in a direction toward the front wall 40 from a plane parallel with the inner surfaces 32 and 34 through the axis of rotation of the rotor, defined by the shafts 55 and 59. At its upper edge, the scoop section 82 is joined to an upwardly outwardly sloping baffle wall 86 which joins the inner surface 41 of the front wall 40, defining with that inner surface and the inner surface 47 of the intermediate wall 46 above the scoop section, an exhaust passage 88, communicating with the mouth 48 of the outlet.

Merely by way of example, if the front wall 7 and back wall 10 of the coil passage are 16" wide and 10" high, and spaced 2.5" outside to outside, the total length of the fan housing and motor can be 16" and the spacing of the back wall 31 from the inlet front wall 33 can be also 2.5" outside to outside. The fan rotor can be 12" long, and 1.125" in diameter. The total height of the front wall of the fan housing can be 4.5". If ⅛" stock is used for the walls, the width of the open inlet mouth is 2.25" and the width of the open outlet mouth, 1.75". Both the inlet and outlet mouths are 12.50" long. The divider walls are on approximate 3" centers, leaving a half inch space between the inboard side wall 37 and the rotor end divider wall 67.

The inlet back wall is 1.75" high and the back wall of the outlet passage, 1.00" high, and the length of the intermediate wall 46 approximately 3.25".

The free edge of the inlet baffle 70 is spaced from the rotor 0.125" measured radially, and extends 0.50" beyond a plane parallel with the front and back walls extending through the axis of rotation of the fan rotor. Measured radially along a line through the axis, perpendicular to the plane of the front and back walls, the baffle is spaced 0.375" and along a radius at 45°, 0.625".

The outlet baffle is of particular importance. The upper edge of the scoop is about 0.75" from the inside surface of the front wall of the housing, and its lower edge, about 1.125". As has been indicated, its lower edge is 0.125" from the rotor, measured radially. Its upper edge is 2.06" above the plane of the open inlet mouth. The scoop part is curved on approximately a 0.5" radius. The upper edge of the sloping wall 86 meets the inside surface of the front wall at a distance of 2.67" from the plane of the open mouth.

As can be seen, the inside surfaces of the front and back walls at the inlet or intake side and at the outlet or exhaust side are parallel, so that the flow of air through the mouths 38 and 48 is substantially parallel.

The rotor can be of a type exemplified by Cross-Flow Blower Wheel NC 30X300 sold by Fergas AB, of Linkoping, Sweden.

With the construction shown and described, the fan assembly delivers 40 cfm at 0.13" of water static pressure at 3,620 rpm and approximately 44 cfm at 0.11".

Transverse flow fans are well known, but they have not been used in refrigeration applications. Conventional transverse flow fan assemblies cannot meet the performance standards of the fan assembly of this invention, even operating at 4,495 rpm. Thus, not only is the application to refrigerant systems unique, but the construction of the fan assembly of this invention provides efficiencies at lower speeds that have not been achieved heretofore, which provides better air flow, improved coil efficiency on account of the relatively even distribution of air flow across the coils, among other things, and quieter operation, thanks to the lower speeds of rotation required and the inlet's being 180° from the outlet in a small overall system depth.

Numerous variations in the construction of the device of this invention, within the scope of the appended claims, will occur to those skilled in the art in the light of the foregoing disclosure. The divider wall 67 may be eliminated by mounting the fan shaft directly to the rotor of the motor, using the rotor shaft bearing as the support bearing. The dimensions can be varied, depending upon the size of the coil passage and the flow of air required. The fan assembly can be used in conjunction with condenser coils as well as with evaporator coils. The fan assembly can be used to force air over the coils, as well as to draw it over. The placement and shape of the divider walls can be varied to direct air or to cause it to be drawn differently. These are merely illustrative.

We claim:

1. In a fan assembly in a refrigerator, by which air is drawn over coils through a coil passage that is thin relative to its width, said coil passage containing said coils, said coil passage being defined by generally parallel front and back walls and side walls extending between said front and back walls, the improvement comprising a fan housing with front, back and side walls, said fan housing having an inlet passage defined by inlet front, back and side walls and having an inlet mouth communicating with said coil passage, an outlet passage having an outlet mouth oriented generally one hundred eighty degrees from said inlet mouth, said outlet passage being defined by outlet front, back and side walls, an intermediate back wall, joining the inlet back wall and a back wall surface defining an edge of the outlet mouth; an elongated, cylindrical transverse flow fan supported by and mounted for rotation, about an axis of rotation, between said inlet side walls, said fan having blades outer edges of which lie in a cylindrical surface of revolution, an electric motor connected to rotate said fan; an outlet baffle having a scoop part with a first edge oriented parallel to the axis of rotation of said fan, spaced closely from said surface of revolution of said fan, said scoop part being concave from said first edge toward said outlet mouth on a side facing an inner surface of said intermediate back wall to receive air leaving said fan and exiting said outlet mouth and walls within said housing spaced from one another in a direction along the axis of rotation of said fan, said walls extending perpendicular to the axis of rotation of said fan from the inlet mouth to the outlet mouth of said fan housing, said walls having openings in them through which said fan extends.

2. The system of claim 1 wherein the coils are evaporator coils.

3. The system of claim 1 wherein the electric motor is a brushless permanent magnet motor.

4. The improvement of claim 1 wherein the distance between the from and back walls defining the coil passage is substantially the same as the distance between the front and back walls defining the inlet passage, and the ratio of that distance to the diameter of the cylindrical transverse flow fan is no greater than about two to one.

* * * * *